US006532633B2

(12) United States Patent
Chu

(10) Patent No.: US 6,532,633 B2
(45) Date of Patent: Mar. 18, 2003

(54) ZIPPER SLIDER

(76) Inventor: Tino Chu, No. 95, Chien Cheng Street, Chien Cheng DT, Kaoshiung (TW)

( * ) Notice: Subject to any disclaimer, the term of this patent is extended or adjusted under 35 U.S.C. 154(b) by 0 days.

(21) Appl. No.: 09/832,972

(22) Filed: Apr. 12, 2001

(65) Prior Publication Data

US 2002/0133917 A1 Sep. 26, 2002

(30) Foreign Application Priority Data

Mar. 26, 2001 (TW) ..... 90204568 U

(51) Int. Cl.[7] ..... A44B 19/26

(52) U.S. Cl. ..... 24/429; 24/419; 24/420; 24/431

(58) Field of Search ..... 24/429, 432, 431, 24/415, 419, 437; 294/3.6; 403/220, 223

(56) References Cited

U.S. PATENT DOCUMENTS 1,962,479 A * 6/1934 Carlile ..... 24/429
2,066,061 A * 12/1936 Sundback ..... 24/429
2,177,344 A * 10/1939 Lange ..... 24/431
2,253,494 A * 8/1941 Carlile ..... 24/429
2,261,132 A * 11/1941 Poux ..... 24/419
2,269,879 A * 1/1942 Marinsky ..... 24/419
2,307,711 A * 1/1943 Schaaff ..... 24/429
3,704,491 A * 12/1972 Burgess ..... 294/3.6
3,831,316 A * 8/1974 Weistrop ..... 446/321
6,353,983 B1 * 3/2002 Oda et al. ..... 24/429

* cited by examiner

*Primary Examiner*—William L. Miller
*Assistant Examiner*—André L. Jackson
(74) *Attorney, Agent, or Firm*—Troxell Law Office PLLC

(57) ABSTRACT

A zipper slider comprises a pull head, and a pull part. The pull slider provides a zipper base joining a proboscis, and the proboscis at both ends thereof is arranged an axial engaging hole respectively. The pull part provides a pull string passing through the axial engaging holes with an end thereof joining a stopper and the other end thereof joining a puller.

5 Claims, 5 Drawing Sheets

ZIPPER SLIDER

BACKGROUND OF THE INVENTION

1. Field of the Invention

The present invention relates to a zipper slider, and particularly to an improvement of zipper slider, which can generate a rectilinear force to perform a better effect of zipper operation.

2. Description of Related Art

The zipper slider has been used as a fastener for joining and separating two parts of an article for years. Due to being easily operated, the zipper slider has replaced other fastening device to a certain extent and, for instance, the zipper has been used as a fastener for almost all wallets and readily made clothes.

The principle of the function of a zipper is that the zipper provides two opposite interlocking tooth tabs and a pulled zipper slider to fasten and unfasten two adjoining edges of an article by way of pulling the zipper slider along the two interlocking tooth tabs. The zipper slider is an essential part to carry out the movement of fastening and unfastening in spite of the interlocking tooth tabs being made of metal, nylon, or fiber reinforced plastics.

The conventional zipper slider, as shown in FIG. 1, has a pull head A and a puller B movably engaging with the pull head A. The puller B has a function of marking out or decorating except being pulled. Therefore, the puller B usually connects with the proboscis (nose part) C of pull head A in a way of an end of the puller B enclosing or surrounding the proboscis C.

The arrangement of combining the pull head A, puller B, and the proboscis C has been used for years without any change. Somehow, a minor change may be made is the configuration of the puller B only, but the device of the puller enclosing or surrounding is kept unchanged.

Under the circumstance of today's highly developed technology, new is a common aim for all industries to pursue incessantly. The slider of a zipper, which is kept immutable, is worth us to self-criticize and make an improvement genuinely.

SUMMARY OF THE INVENTION

An object of the present invention is to provide a zipper slider, in which the puller engages with a connection string instead of attaching to the probe directly to improve the effectiveness of the force exerted to pull the zipper slider.

BRIEF DESCRIPTION OF THE DRAWINGS

The present invention can be more fully understood by referring to the following description and accompanying drawings, in which.

DETAILED DESCRIPTION OF THE PREFERRED EMBODIMENTS

Figure 1:
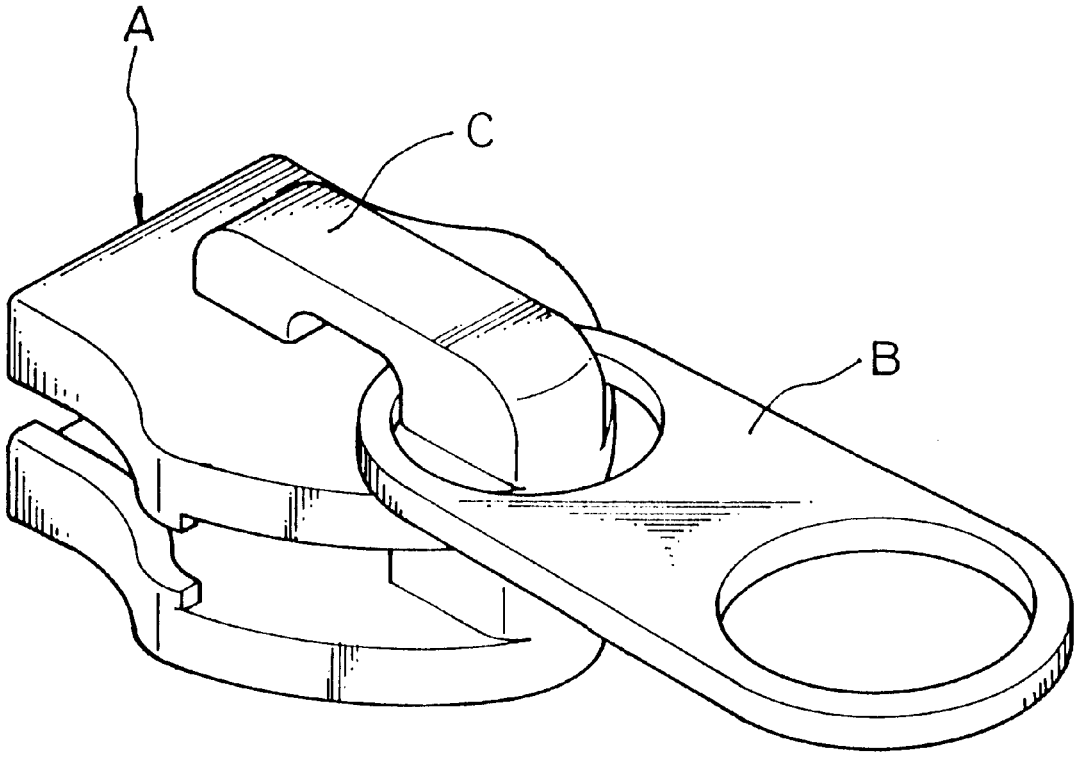
FIG. 1 PRIOR ART
FIG. 1 is a perspective view of a conventional zipper slider.
Figure 2:
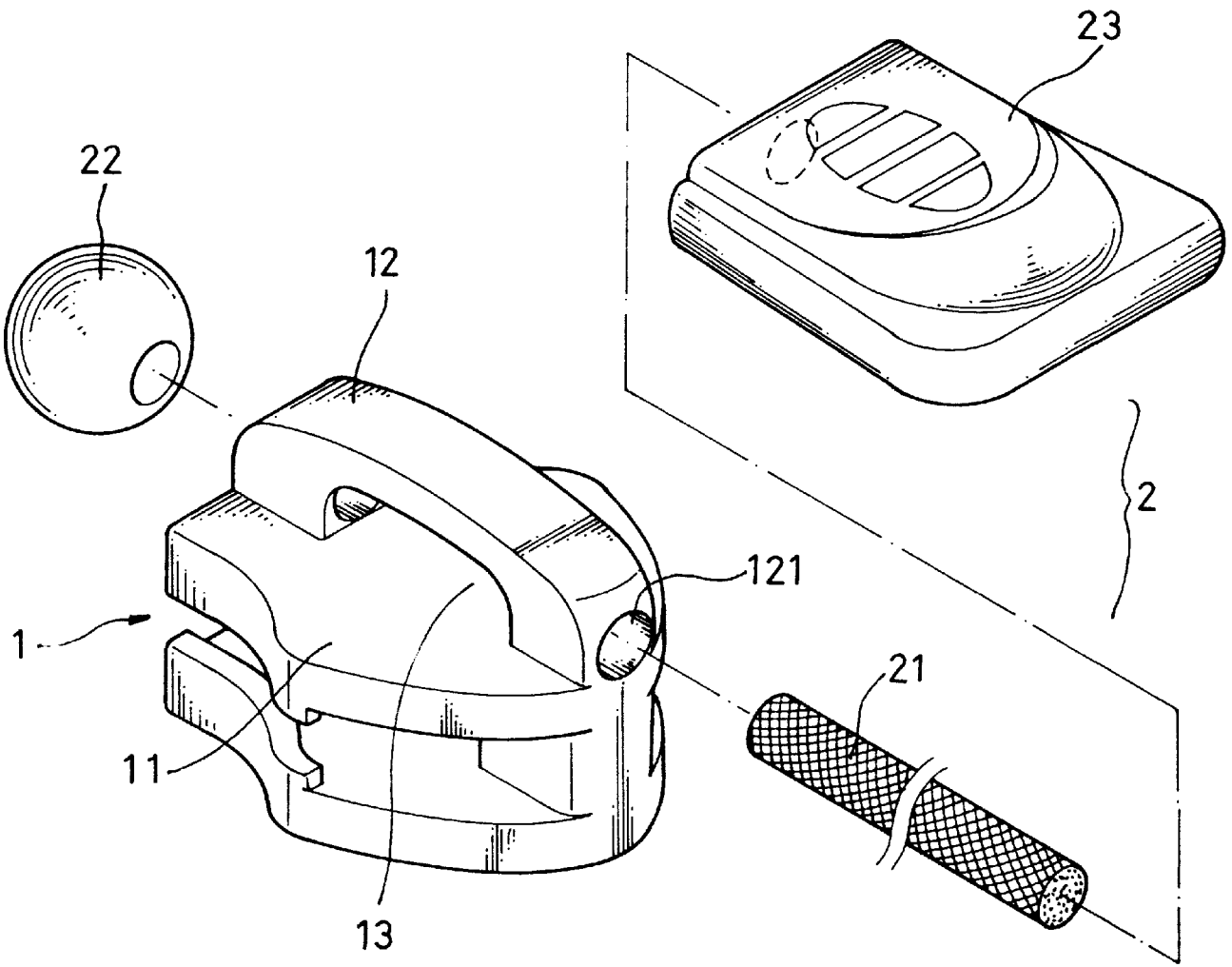
FIG. 2 is an exploded perspective view of a zipper slider according to the present invention.

Referring to FIG. 2, a zipper slider of present invention comprises a pulled head 1 and a pull part 2.

Wherein, the pulled head 1 at the lower part thereof part thereof is a zipper base 11 and at the upper surface thereof is associated with a proboscis 12 with a hollow part 13 between the proboscis 12 and the upper surface of zipper base 11. But, the pulled head 1 has the same structure as the conventional zipper does so that no detail will be described further.

The proboscis 12 at both ends thereof provides an axial pierced hole 121 respectively extending inward from outside respectively to be passed through by a pull string 21. The arrangement of probe 2 in the present invention is different from the conventional one.

The pulled part 2 is provided for being pulled by the user and is composed of the pull string 21 and a stopper 22 at an end of the pull string 21 and a puller 23 at another end of the pull string 21. As shown in FIG. 2, the pull string 21 at both ends thereof fixes with the stopper 22 and the puller 23 respectively after being assembled. Hence, the stopper 22 and the puller 23 have a size greater than the axial pierced holes 121 respectively. The pulled piece 23 may be a plate, a doll or an article with other figures or significant characters or decorative patterns. The pull string 21 has a length greater than the probe 12.

Figure 3:
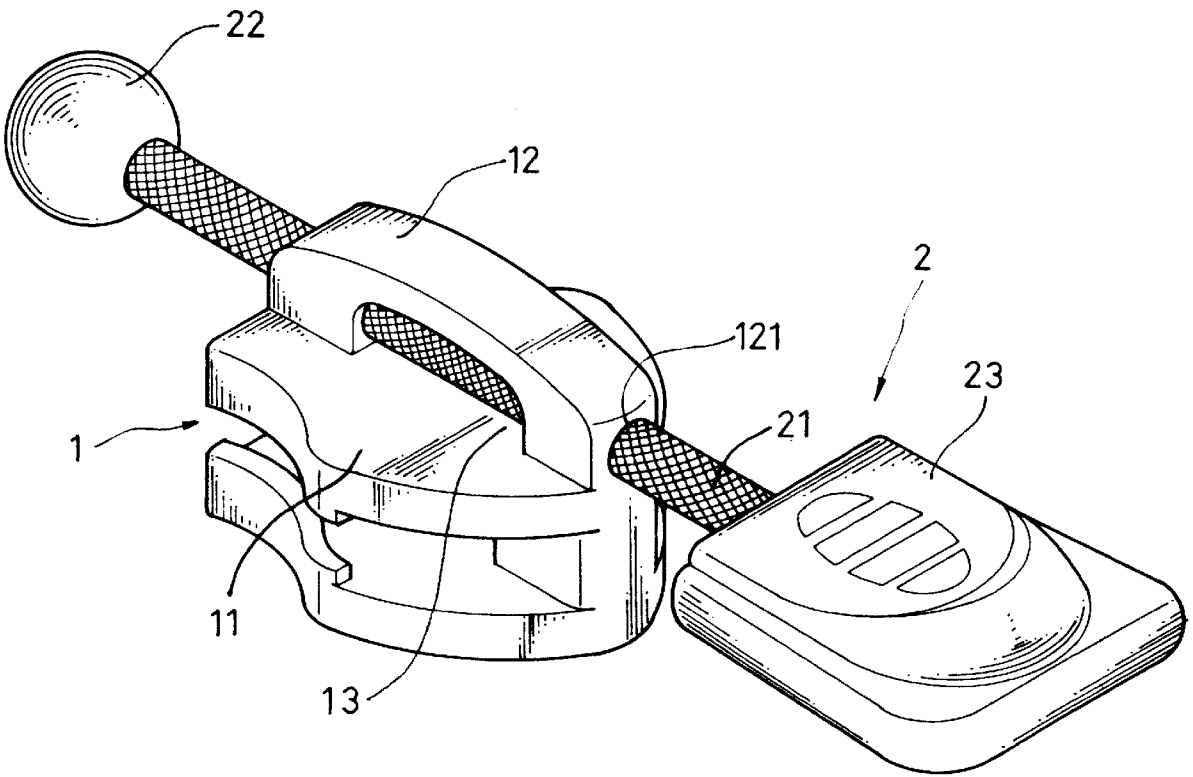
FIG. 3 is a perspective view illustrating the zipper slider shown in FIG. 2 after assemble.

Referring to FIG. 3, the pull string 21 is arranged to pass through the two axial pierced holes 121 with an end thereof fixing with the stopper 22 and the other end thereof being fixedly attached by the puller 23 as soon as the zipper slider is assembled. Thus, the zipper slider can be moved along in a direction by puller 23 and in the other direction by stopper 22.

Figure 4:
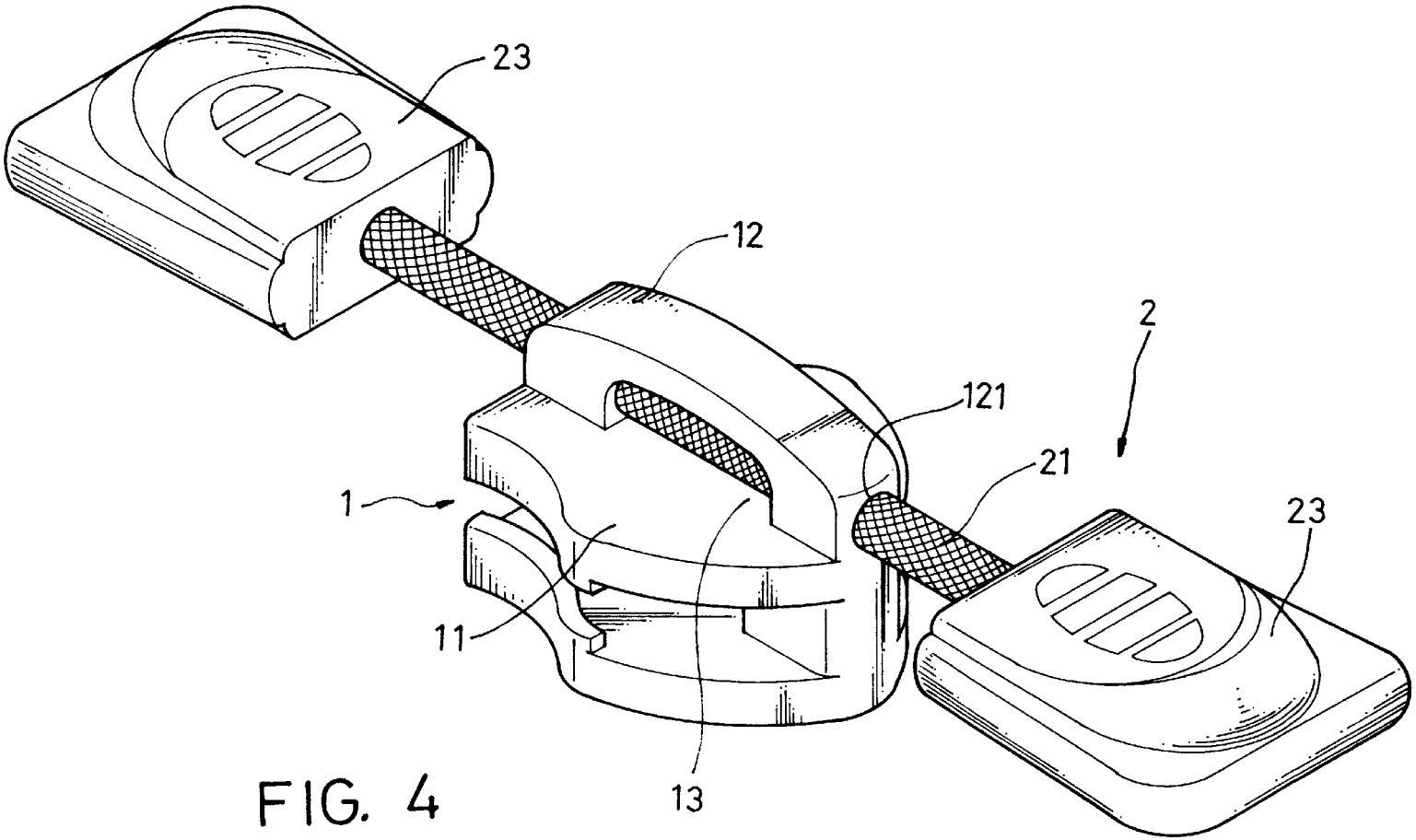
FIG. 4 is a perspective view of another zipper slider according to the present invention providing two pull pieces.

Referring to FIG. 4, the stopper 22 shown in FIG. 3 can be replaced by another puller 23, which has either the same configuration as the puller 23 at the other end of the pull string 21 or a different configuration from the puller 23, to perform the identical function as the zipper slider shown in FIG. 3 does.

Figure 5:
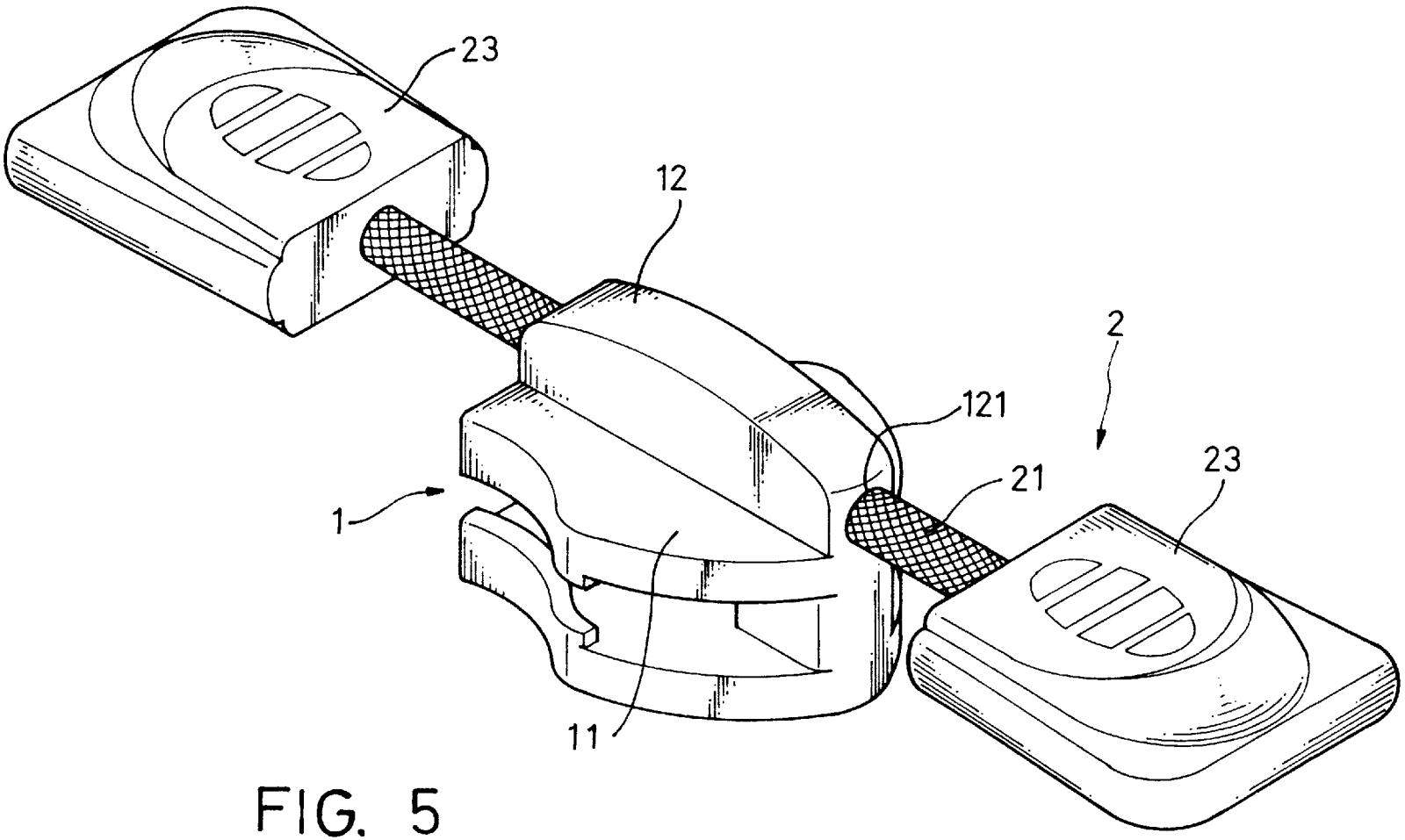
FIG. 5 is a perspective view of a further zipper slider according to the present invention providing a nose without piercing hole.

Referring to FIG. 5, the proboscis 12 with the hollow part 13 shown in FIGS. 2 to 4 is replaced by a solid proboscis 12 with an axial pierced hole 121 passing through the entire proboscis 12.

It is appreciated that the present invention has the probe at both ends thereof or an end thereof provide a puller to generate a rectilinear exerted force during the slider being pulled instead of the conventional puller, which having been used for long period of time and at an end thereof enclosing or surrounding the proboscis. Hence, the zipper slider of the present invention can lead to a better rectilinear pulling force directly in addition to promoting the function of marking out provided by the puller. It is not possible for the prior art, which has been applied in the conventional zipper slider for a long period of time, to reach the feature offered by the present invention.

While the invention has been described with reference to preferred embodiments thereof, it is to be understood that modifications or variations may be easily made without departing from the spirit of this invention, which is defined by the appended claims.

What is claimed is:

1. A zipper slider comprising:

a) a pull head including a zipper base with a proboscis member extending outwardly from one side of the zipper base, the proboscis member extending along an entire longitudinal length of the zipper base, the proboscis member having a longitudinal hole therethrough; and, b) a zipper pull including a pull string passing through the longitudinal hole in the proboscis member, and two pullers, one attached to each opposite end of the pull string such that the pullers are located outwardly of opposite longitudinal ends of the pull head.

2. The zipper slider of claim 1 wherein one of the two pullers comprises a ball shaped stopper.

3. The zipper slider of claim 1 further comprising a hollow between a portion of the proboscis member and the pull head.

4. The zipper slider of claim 1 wherein at least one of the two pullers is plate shaped.

5. The zipper slider of claim 4 wherein both of the two pullers are plate shaped.

* * * * *